US005779824A

United States Patent [19]

Sawada et al.

[11] Patent Number: 5,779,824

[45] Date of Patent: Jul. 14, 1998

[54] ALUMINUM ALLOY SUPPORT FOR PLANOGRAPHIC PRINTING PLATE AND METHOD FOR PRODUCING THE SAME

[75] Inventors: Hirokazu Sawada; Hirokazu Sakaki; Tsutomu Kakei; Akio Uesugi; Masaya Matsuki, all of Shizuoka, Japan

[73] Assignee: Fuji Photo Film Co., Ltd., Kanagawa, Japan

[21] Appl. No.: 504,676

[22] Filed: Jul. 20, 1995

[30] Foreign Application Priority Data

| | | | |
|---|---|---|---|
| Aug. 5, 1994 | [JP] | Japan | 6-184900 |
| Sep. 21, 1994 | [JP] | Japan | 6-226735 |
| Oct. 7, 1994 | [JP] | Japan | 6-244427 |

[51] Int. Cl.[6] ..... C22C 21/00

[52] U.S. Cl. ..... 148/437; 148/437; 148/438; 420/528; 420/537; 420/538; 420/529; 420/551; 420/548; 420/547

[58] Field of Search ..... 420/528, 537, 420/538, 529, 551, 548, 547; 148/437, 438

[56] References Cited

FOREIGN PATENT DOCUMENTS

| | | | |
|---|---|---|---|
| 0067056 | 12/1982 | European Pat. Off. . | |
| 0581321 | 2/1994 | European Pat. Off. . | |
| 0643149 | 3/1995 | European Pat. Off. . | |
| 0652298 | 5/1995 | European Pat. Off. . | |
| 0653497 | 5/1995 | European Pat. Off. . | |
| 0672759 | 9/1995 | European Pat. Off. | C22C 21/00 |
| A7138687 | 5/1995 | Japan | C22C 21/00 |

*Primary Examiner*—David A. Simmons
*Assistant Examiner*—M. Alexandra Elve
*Attorney, Agent, or Firm*—Sughrue, Mion, Zinn, Macpeak & Seas, PLLC

[57] ABSTRACT

An aluminum alloy support for a planographic printing plate is disclosed, which is an aluminum alloy plate comprising $0<Fe\leqq0.20$ wt %, $0\leqq Si\leqq0.13$ wt %, $Al\geqq99.7$ wt % and the balance of inevitable impurity elements, wherein the number of intermetallic compounds present in the arbitrary thickness direction with in 10 μm from the plate surface is from 100 to 3,000 per $mm^2$ and the intermetallic compound has an average particle size of from 0.5 to 8 μm, with the intermetallic compounds having a particle size of 10 μm or more being in a proportion by number of 2% or less. Also disclosed is a method for producing the above-described aluminum alloy support.

4 Claims, 4 Drawing Sheets

ALUMINUM ALLOY SUPPORT FOR PLANOGRAPHIC PRINTING PLATE AND METHOD FOR PRODUCING THE SAME

FIELD OF THE INVENTION

The present invention relates to an aluminum alloy support for a planographic printing plate and a method for producing the same, particularly to an aluminum alloy support for a planographic printing plate suitable for an electrochemical graining treatment and a method for producing the same.

BACKGROUND OF THE INVENTION

As an aluminum support for printing plate, particularly for offset printing plate there is used an aluminum plate (including aluminum alloy plate).

In general, an aluminum plate to be used as a support for offset printing plate needs to have a proper adhesion to a photosensitive material and a proper water retention.

The surface of the aluminum plate should be uniformly and finely grained to meet the aforesaid requirements. This graining process largely affects a printing performance and a durability of the printing plate upon the printing process following manufacture of the plate. Thus, it is important for the manufacture of the plate whether such graining is satisfactory or not.

In general, an alternating current electrolytic graining method is used as the method of graining an aluminum support for a printing plate. There are a variety of suitable alternating currents, for example, a normal alternating waveform such as a sinewaveform, a special alternating waveform such as a squarewaveform, and the like. When the aluminum support is grained by alternating current supplied between the aluminum plate and an opposite electrode such as a graphite electrode, this graining is usually conducted only one time, as the result of which, the depth of pits formed by the graining is small over the whole surface thereof. Also, the durability of the grained printing plate during printing will deteriorate. Therefore, in order to obtain a uniformly and closely grained aluminum plate satisfying the requirement of a printing plate with deep pits as compared with their diameters, a variety of methods have been proposed as follows.

One method is a graining method to use a current of particular waveform for an electrolytic power source (JP-A-53-67507). (The term "JP-A" as used herein means an "unexamined published Japanese patent application".) Another method is to control a ratio between an electricity quantity of a positive period and that of a negative period at the time of alternating electrolytic graining (JP-A-54-65607). Still another method is to control the waveform supplied from an electrolytic power source (JP-A-55-25381). Finally, another method is directed to a combination of current density (JP-A-56-29699).

Further, known is a graining method using a combination of an AC electrolytic etching method with a mechanical graining method (JP-A-55-142695).

As the method of producing an aluminum support, on the other hand, known is a method in which an aluminum ingot is melted and held, and then cast into a slab (having a thickness in a range from 400 to 600 mm, a width in a range from 1,000 to 2,000 mm, and a length in a range from 2,000 to 6,000 mm). Then, the cast slab thus obtained is subjected to a scalping step in which the slab surface is scalped by 3 to 10 mm with a scalping machine so as to remove an impurity structure portion on the surface. Next, the slab is subjected to a soaking treatment step in which the slab is kept in a soaking furnace at a temperature in a range from 480° to 540° C. for a time in a range from 6 to 12 hours, thereby to remove any stress inside the slab and make the structure of the slab uniform. Then, the thus treated slab is hot rolled at a temperature in a range from 480° to 540° C. to a thickness in a range from 5 to 40 mm. Thereafter, the hot rolled slab is cold rolled at room temperature into a plate of a predetermined thickness. Then, in order to make the structure uniform and improve the flatness of the plate, the thus cold rolled plate is annealed thereby to make the rolled structure, etc. uniform, and the plate is then subjected to correction by cold rolling to a predetermined thickness. Such an aluminum plate obtained in the manner described above has been used as a support for a planographic printing plate.

However, electrolytic graining is apt to be influenced by an aluminum support to be treated. If an aluminum support is prepared through melting and holding, casting, scalping and soaking, even though passing through repetition of heating and cooling followed by scalping of a surface layer, scattering of the metal alloy components is generated in the surface layer, causing a drop in the yield of a planographic printing plate.

A method for producing a support for a planographic printing plate described in U.S. Pat. No. 5,078,805 (corresponding to JP-A-3-79798) characterized by that casting and hot rolling are continuously carried out from molten aluminum to form a hot rolled coil of thin plate and then, an aluminum support subjected to cold rolling, heat-treatment and correction is subjected to a graining treatment was previously proposed by the present applicant as a method in which a planographic printing plate having an excellent quality and a good yield can be produced by decreasing dispersion in a material quality of the aluminum support to improve a yield of an electrolytic graining treatment.

In addition thereto, it is proposed in U.S. Pat. No. 5,350,010 (corresponding to JP-A-6-48058) that in order to obtain a good electrolytic graining property, a continuous casting is carried out with a mixing ratio comprising Fe: 0.4 to 0.2 wt %, Si: 0.2 to 0.05 wt %, Cu: 0.02 wt % or less and Al: 99.5 wt % or more, wherein of a content of Fe, 20 to 90 wt % exists in a grain boundary.

Further, JP-A-62-146694, JP-A-60-230951, JP-A-60-215725, JP-A-61-26746, and JP-B-58-6635 (the term "JP-B" as used herein means an "examined Japanese patent publication").

Also, the present inventors have proposed in JP-A-5-301478 to prescribe the alloy components of the support and that the concentration distribution of the alloy components is within the average concentration ±0.05%.

Further, the present inventors have proposed in Japanese Patent Application Nos. 5-249699 and 6-71264 to produce a support for a planographic printing plate at a low cost by simplifying the raw materials. In addition, they have proposed in Japanese Patent Application No. 5-307108 an aluminum alloy substrate for a planographic printing plate characterized in that an aluminum alloy substrate is produced by continuously cast-rolling a plate directly from molten aluminum so as to obtain good electrolytic graining properties and then subjecting it to cold rolling, heat treatment and correction in an appropriate manner, in which the number and the size of intermetallic compounds are controlled to fall in a prescribed range.

However, even the production method previously proposed in JP-A-6-48058 involves dispersion in the yield of the electrolytic graining treatment and in the graining suitability depending upon the components of the aluminum support.

Also, the production methods described in JP-A-6-48058 and JP-A-5-301478 previously filed by the present inventors are deficient in that, as shown in FIG. 2, when the aluminum plate is continuously cast-rolled from molten aluminum by means of twin rollers, stepped irregularities (i.e., stepped unevenness) 8 extending in the direction perpendicular to the rolling direction, namely in the width direction of an aluminum plate 7, are formed on the surface of the aluminum plate 7. In the same figure, the potions between adjacent unevennesses 8 are uniform in the alloy composition and the constitution (regular portion 11). The unevennesses 8 do not disappear even in subsequent cold rolling and intermediate annealing but disadvantageously remain on the surface of a planographic printing plate after graining treatment as stepped unevennesses.

SUMMARY OF THE INVENTION

An object of the present invention is to provide an aluminum alloy support for a planographic printing plate, which decreases dispersion in the material quality of an aluminum alloy support, improves the yield of electrolytic graining treatment and has excellent suitability to graining to thereby produce a planographic printing plate at a low cost, and a method for producing the same.

Another object of the present invention is to provide a method for producing a support for a planographic printing plate excellent in the surface quality after graining, which can be conducted in a stable manner at a low cost through a continuous cast-rolling with twin rollers while reducing stepped unevennesses generated at the time of the continuous cast-rolling with twin rollers.

The present inventors have made intensive investigations on the relation between the aluminum support and the electrolytic graining treatment and found that the cause of dispersion in graining resides in dispersion in a distribution of trace alloy components such as Fe, Si, Cu and Ti, in particular, that dispersion in the distribution of trace alloy components each present in the form of an intermetallic compound is the cause of uneven graining, and based on these findings, they have accomplished the present invention.

Further, the present inventors have found that in order to reduce the cost of raw materials while keeping freedom from dispersion in the suitability to graining, it is important to generate pits having a stable form at the electrolytic graining, in particular, not to damage the edge portion of pits, and that this can be achieved by letting a fine intermetallic compound having a particle size of 0.1 μm or less be present and based on these findings, they have accomplished the present invention.

Still further, the present inventors have made intensive investigations on the stepped unevennesses generated at the time of continuous cast-rolling and found that the portions appearing as stepped unevennesses can be classified into two patterns, one is the portion where the alloy components such as Fe and Si closely collect in the form of an intermetallic compound to form a stepped distribution and another is the portion where the alloy components such as Fe and Si are exclusively thinned there in the concentration. Also, the present inventors have investigated the relation between the uneven distribution of alloy components at the time of continuous cast-rolling and the graining properties of a final plate and as a result, they have accomplished the present invention capable of providing a good support for a planographic printing plate.

The above-described objects have been achieved by:

(1) an aluminum alloy support for a planographic printing plate, which is an aluminum alloy plate comprising $0<Fe\leqq0.20$ wt %, $0\leqq Si\leqq0.13$ wt %, $Al\geqq99.7$ wt % and the balance of inevitable impurity elements, wherein the number of intermetallic compounds present in the arbitrary thickness direction within 10 μm from the plate surface are from 100 to 3,000 per $mm^2$ and the intermetallic compound has an average particle size of from 0.5 to 8 μm, with the intermetallic compounds having a particle size of 10 μm or more being in a proportion by number of 2% or less;

(2) preferably, the aluminum alloy support for a planographic printing plate described in the above item (1), wherein the components of the aluminum alloy support contain $0\leqq Ti\leqq0.05$ wt % and $0\leqq Cu\leqq0.05$ wt %;

(3) an aluminum alloy support for a planographic printing plate, which is an aluminum alloy plate comprising $0<Fe\leqq0.20$ wt %, $0\leqq Si\leqq0.13$ wt %, $Al\geqq99.7$ wt % and the balance of inevitable impurity elements, wherein the intermetallic compounds contained in the aluminum alloy plate and having a particle size of 0.1 μm or less are present at a proportion of 0.5 wt % or more of all intermetallic compounds;

(4) preferably, the aluminum alloy support for a planographic printing plate as described in the above item (3), wherein the aluminum alloy support contains $0\leqq Ti\leqq0.05$ wt % and $0\leqq Cu\leqq0.05$ wt %;

(5) a method for producing a support for a planographic printing plate comprising a series of steps for continuously cast-rolling a plate with twin rollers directly from molten aluminum, for carrying out either or both of cold rolling and annealing, for correcting the aluminum plate and then for graining the aluminum support, wherein the components of molten aluminum comprise $0<Fe\leqq0.20$ wt %, $0\leqq Si\leqq0.13$ wt % and $Al\geqq99.7$ wt % and the continuous cast-rolling is carried out so that the plate after continuous cast-rolling has a ratio of the concentration distribution difference of the alloy components in the rolling direction to the concentration distribution difference of the alloy components in the width direction of from 0.2 to 5; and (6) preferably, the method for producing a support for a planographic printing plate described in the above item (5), wherein the components of the molten aluminum contain $0\leqq Cu\leqq0.05$ wt % and $0\leqq Ti\leqq0.05$ wt %.

Figure 1:
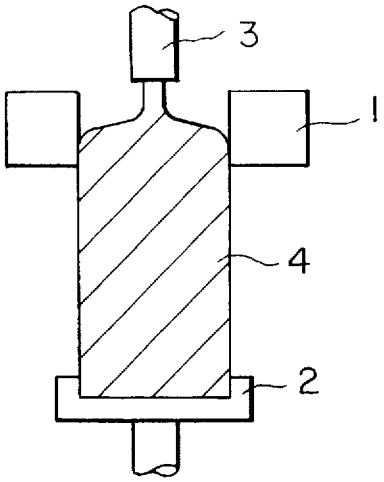
FIG. 1 is a conceptual view showing one example of the casting process in the method for producing a support for a planographic printing plate according to the present invention.

(7): Aluminum plate continuous-casted (8): Stepped unevenness (9): Alloy component distribution-measurement range (10*a*): Concentration distribution-measurement direction (Rolling direction)

(10*b*): Concentration distribution-measurement direction (Plate width direction)

(11): Regular portion

DETAILED DESCRIPTION OF THE INVENTION

In the present invention, a casting technique such as a DC method is put to practical use for a method to produce an aluminum cast ingot from molten aluminum with, for example, use of a fixed cast mold.

A method using a cooling belt, such as a Hazelett method and a method using a cooling roller, such as a Hunter method and a 3C method can be used as a continuous casting method using a driven cast mold. Further, a method for producing a coil of a thin plate is disclosed in JP-A-60-238001 and JP-A-60-240360.

With respect to the above-described method for forming a coil by continuous casting with twin rollers from molten aluminum, techniques for continuously casting a thin plate such as a Hunter method and a 3C method are used in practice. According to these methods, the molten aluminum can be solidified and at the same time rolled and the continuously cast-rolled plate usually has a thickness of from 2 to 10 mm.

According to the present invention, in order to achieve excellent properties as the aluminum alloy support for a planographic printing plate, the alloy components are constituted to satisfy the above-described range and although the alloy components are present in the form of an intermetallic compound, the number thereof per unit area, the average particle size thereof and the proportion by number of those having a particle size of 10 μm or more are selected while realizing at the same time, simplification of raw materials.

Further, according to the present invention, in order to achieve excellent properties as the aluminum alloy support for a planographic printing plate, the alloy components are set to satisfy the above-described range and by letting intermetallic compounds having a very fine particle size be present among intermetallic compounds contained in an aluminum alloy plate, simplification of raw materials and excellent suitability to electrolytic graining are obtained.

Furthermore, according to the present invention, in order to achieve excellent properties as the aluminum alloy support for a planographic printing plate, the alloy components of molten aluminum are prescribed and the ratio of concentration distribution difference of the aluminum components in the rolling direction of a plate after continuous cast-rolling to the concentration distribution difference of the alloy components in the width direction is also prescribed to thereby solve the stepped unevenness generated on the continuously cast-rolled plate.

The analysis of the intermetallic compounds in the aluminum alloy may be made by a surface analysis method using an Electron-Probemicroanalyzer (EPMA) or an extractive separation method using a heat phenol.

The intermetallic compound as used herein means an aluminum alloy component which does not form a solid solution and crystallized as a compound (e.g., $FeAl_3$, $FeAl_6$, α-AlFeSi, $TiAl_3$, $CuAl_2$, etc.) in the form of an eutectic crystal in the aluminum alloy (see, *Aluminum Zairyo no Kiso to Kogyo Gijutsu*, issued by Corporate Judicial Person, Kei-Kinzoku Kyokai, page 32).

In the present invention, the number of intermetallic compounds present in the arbitrary thickness direction within a depth of 10 μm from the plate surface is from 100 to 3,000, preferably from 300 to 2,000, more preferably from 500 to 1,500, per $mm^2$.

The intermetallic compound has an average particle size of from 0.5 to 8 μm, preferably from 0.5 to 5 μm.

Further, the intermetallic compound having a particle size of 10 μm or more is present at a proportion by number of 2 wt % or less, preferably 1 wt % or less.

Furthermore, in the present invention, the intermetallic compound having a particle size of 0.1 μm or less is present at a proportion of 0.5 wt % or more, preferably 1 wt % or more, more preferably 2 wt % or more, of all intermetallic compounds. The upper limit of the proportion is preferably 10 wt % or less.

The particle size of the intermetallic compound is determined by a method where an aluminum alloy plate is dissolved in a heat phenol and after solidification prevention treatment, the liquid melt is filtered through a filter having a predetermined pore size to extract intermetallic compounds or a method where intermetallic compounds are separated as solid content from a liquid melt or a filtrate by a centrifugal separator and then the separated compounds are observed through a scanning electron microscope (SEM) to determine the size.

Also, the total amount of intermetallic compounds can be determined in such a manner that the weight (a) of the residue after extraction by filtration through a filter having a predetermined pore size is measured, the weight (b) of intermetallic compounds passed through the above-described filter and separated by a centrifugal separator or distillation under reduced pressure is measured and then the weight (a) and the weight (b) are summed up.

The weight percentage of the alloy components in the aluminum alloy can be quantitatively determined by an emission analysis.

In the present invention, the Fe component satisfies the condition of generally $0<Fe\leqq0.20$ wt %, preferably $0.05\leqq Fe\leqq0.19$ wt %, more preferably $0.08\leqq Fe\leqq0.18$ wt %.

The Si component satisfies the condition of generally $0\leqq Si\leqq0.13$ wt %, preferably $0.02\leqq Si\leqq0.12$ wt %, more preferably $0.025\leqq Si\leqq0.10$ wt %.

The Cu component satisfies the condition of generally $0 \leqq Cu \leqq 0.05$ wt %, preferably $0.001 \leqq Cu \leqq 0.008$ wt %.

The Ti component satisfies the condition of generally $0 \leqq Ti \leqq 0.05$ wt %, preferably $0 \leqq Ti \leqq 0.03$ wt %.

Note here that in general, Ti is added as a crystal-pulverizing agent and Cu is added to control the shape of a grained pit.

The condition of $Al \geqq 99.7$ wt % is effective on reduction in the cost of raw materials because an $Al \geqq 99.7$ wt % ingot material which is commercially available at a low cost can be used. Also, in order to prevent deterioration of the graining form, the upper limit of the Al content is preferably less than 99.99 wt %.

Other inevitable impurities (e.g., Mg, Mn, Cr, Zr, V, Zn, Be) are contained in a small amount and accordingly, no particular bad effect is drawn to cause stepped unevenness on the continuously cast-rolled plate or is provided on the surface treatment property, staining property and burning property of the final plate.

The raw material for the Fe component may be a commercially available Al-Fe mother alloy having an Fe content of 50 wt %, the raw material for the Si component may be a commercially available Al-Si mother alloy having an Si content of 25 wt %, the raw material for the Cu component may be a commercially available Al-Cu mother alloy having a Cu content of 50 wt % and the raw material for the Ti component may be a commercially available Al-Ti mother alloy or linear Al-Ti-B alloy having a Ti content of 5 wt %.

Each of Fe, Si, Cu and Ti components is added at the melting of an $Al \geqq 99.7$ wt % ingot material to satisfy the above-described weight range. In some cases, a modicum amount of Fe or Si may be contained in the 99.7 wt % Al ingot material and the raw material for the Fe or Si component is added by taking the amount into consideration. The 99.7 wt % Al ingot material may contain a very modicum amount of Cu or Ti or may not contain Cu or Ti and the raw material for the Cu or Ti component is also added by taking the amount into consideration.

The above-described aluminum alloy support for a planographic printing plate according to the present invention is produced specifically in the following manner so that the cost is reduced, stable suitability to graining is provided and the number and the size of intermetallic compounds are controlled or so that fine intermetallic compounds are contained.

Figure 3:
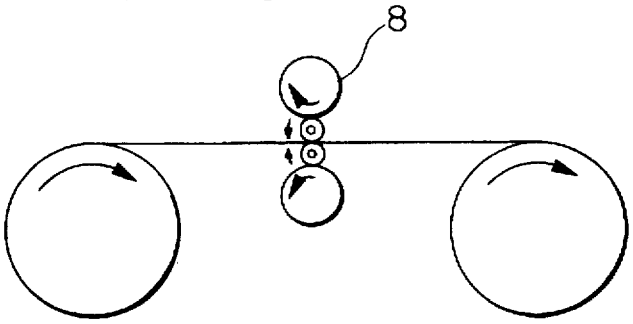
FIG. 3 is a conceptual view showing one example of the cold rolling process in the method for producing a support for a planographic printing plate according to the present invention.
Figure 4:
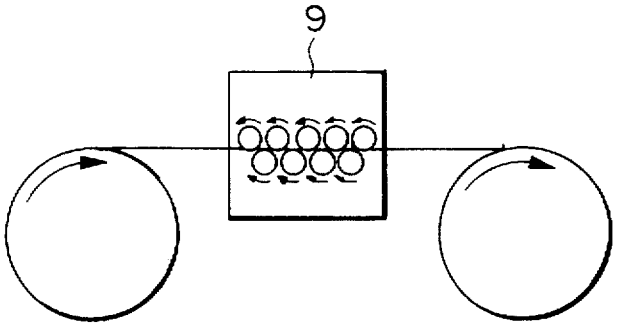
FIG. 4 is a conceptual view showing one example of the correcting process in the method for producing a support for a planographic printing plate according to the present invention.

By the conceptual views of FIG. 1 to FIG. 4, one of the embodiments of the production method for the aluminum alloy support used in the present invention is concretely explained below. An Al material is melted and adjusted to $0 < Fe \leqq 0.20$ weight % and $0 \leqq Si \leqq 0.13$ weight % in a melt holding furnace (which is not illustrated), and as shown in FIG. 1, the (molten aluminum) melt is supplied from the molten aluminum-supplying nozzle 3 to the ingot-receiving tray 2 through the water-cooling fixed casting mold 1 to form the ingot 4, wherein the ingot is subjected to scalping and to a heat treatment at a temperature of 280° C. to 650° C., preferably 400° C. to 630° C. and particularly preferably 500° C. to 600° C. for time of 2 hours to 15 hours, preferably 4 hours to 12 hours and particularly preferably 6 hours to 11 hours; then, as shown in FIG. 3, it is subjected to cold rolling with the cold rolling machine 8 to roll to a thickness of 0.5 mm to 0.1 mm; and further it is subjected to the correction with the correction apparatus 9 to thereby produce an aluminum support, as shown in FIG. 4. The rolling may be carried out with the hot rolling machine (which is not illustrated) or may be carried out with combination of the hot rolling machine and the cold rolling machine.

Figure 2:
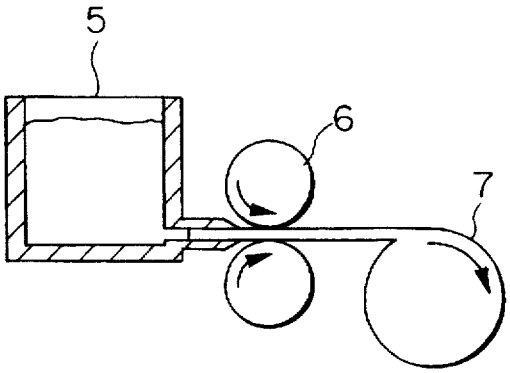
FIG. 2 is a conceptual view showing another example of the casting process in the method for producing a support for a planographic printing plate according to the present invention.

Also an Al material is melted and adjusted to $0 < Fe \leqq 0.20$ weight % and $0 \leqq Si \leqq 0.13$ weight % in the melt holding furnace, as shown in FIG. 2, and then a plate having a thickness of 2 to 10 mm may be produced with the twin roller continuous casting machine 6. Next, after subjecting it to the cold rolling with the cold rolling machine 8 as shown in FIG. 3 to roll it to a thickness of 0.5 to 0.1 mm, it is further subjected to the correction with the correction apparatus 9 to thereby produce an aluminum support, as shown in FIG. 4.

Figure 5:
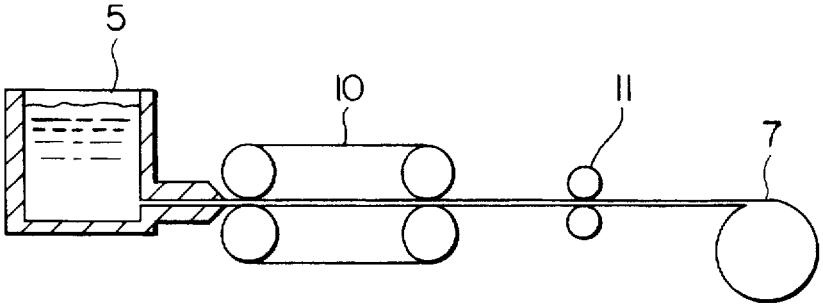
FIG. 5 is a conceptual view showing still another example of the casting process in the method for producing a support for a planographic printing plate according to the present invention.

Also, in the case where the Al raw material is molten and adjusted in a melt holding furnace so as to have a constitution that $0 < Fe \leqq 0.20$ wt % and $0 \leqq Si \leqq 0.13$ wt % and formed into a plate having a thickness of approximately from 4 to 30 mm with a twin belt continuous casting machine, the plate is thereafter subjected to cold rolling with a cold rolling machine 8 as shown in FIG. 3 and corrected by a correcting apparatus 9 as shown in FIG. 4, to thereby produce an aluminum support. When a twin belt continuous casting machine 10 is used, hot rolling may be carried out immediately after the continuous casting with a hot rolling machine 11 as shown in FIG. 5.

The method for producing a support for a planographic printing plate according to the present invention is described below more specifically by referring to FIGS. 6(A) to 6(D) which are conceptual views showing an embodiment of the method for producing a support for a planographic printing plate according to the present invention.

An ingot is molten and held in a melt holding furnace (1) and then transferred to a twin roller continuous casting machine (2). In other words, a coil of thin plate is formed directly from molten aluminum. The coil may be wound around a coiler (6) or may be subsequently subjected to heat treatment and then applied to a cold rolling machine and a correction apparatus.

The conditions in the production is described below in detail.

The temperature of the melt holding furnace (1) must be kept higher than the melting point of aluminum and varies depending on the aluminum alloy components. The temperature is usually 800° C. or higher.

In order to prevent the generation of an oxide of molten aluminum or to eliminate an alkali metal having an adverse effect on the quality, such as Na, Li or Ca, which is eluted from the furnace wall of the melt holding furnace (1), an inert gas purging or flux treatment may be carried out in an appropriate manner.

Thereafter, a plate is casted by the twin roller continuous casting machine (2). Various casting methods may be present but industrially operated at present is mostly a Hunter method or a 3C method.

The casting temperature may vary depending upon the cooling condition of the mold but it is optimally around 700° C. After the continuous casting, the crystal grain size, cooling condition, casting rate and variable amount of the plate thickness during casting are controlled and the resulting plate after continuous casting is rolled to a prescribed thickness with a cold rolling machine (3). At this time, treatments such as intermediate annealing by a heat treating machine (4) and further by a cold rolling machine may be interposed so as to regulate the crystal grain to a predetermined size. Then, correction by a correcting apparatus (5) is carried out to give a predetermined flatness to thereby produce an aluminum support which is then grained. The correction is sometimes included in the final cold rolling.

As the method for graining the support for planographic printing plate according to the present invention, there is used mechanical graining, chemical graining, electrochemical graining or combination thereof.

Examples of mechanical graining methods include ball graining, wire graining, brush graining, and liquid honing. As electrochemical graining method, there is normally used AC electrolytic etching method. As electric current, there is used a normal alternating current such as sinewaveform or a special alternating current such as squarewaveform, and the like. As a pretreatment for the electrochemical graining, etching may be conducted with caustic soda.

If electrochemical graining is conducted, it is preferably carried out with an alternating current in an aqueous solution mainly composed of hydrochloric acid or nitric acid. The electrochemical graining is further described hereinafter.

First, the aluminum is etched with an alkali. Preferred examples of alkaline agents include caustic soda, caustic potash, sodium metasilicate, sodium carbonate, sodium aluminate, and sodium gluconate. The concentration of the alkaline agent, the temperature of the alkaline agent and the etching time are preferably selected from 0.01 to 20%, 20° to 90° C. and 5 sec. to 5 min., respectively. The preferred etching rate is in the range of 0.1 to 5 g/m$^2$.

In particular, if the support contains a large amount of impurities, the etching rate is preferably in the range of 0.01 to 1 g/m$^2$ (JP-A-1-237197). Since alkaline-insoluble substances (smut) are left on the surface of the aluminum plate thus alkali-etched, the aluminum plate may be subsequently desmutted as necessary.

The pretreatment is effected as mentioned above. In the present invention, the aluminum plate is subsequently subjected to AC electrolytic etching in an electrolyte mainly composed of hydrochloric acid or nitric acid. The frequency of the AC electrolytic current is in the range of generally 0.1 to 100 Hz, preferably 0.1 to 1.0 Hz or 10 to 60 Hz.

The concentration of the etching solution is in the range of generally 3 to 150 g/l, preferably 5 to 50 g/l. The solubility of aluminum in the etching bath is preferably in the range of not more than 50 g/l, more preferably 2 to 20 g/l. The etching bath may contain additives as necessary. However, in mass production, it is difficult to control the concentration of such an etching bath.

The electric current density in the etching bath is preferably in the range of 5 to 100 A/dm$^2$, more preferably 10 to 80 A/dm$^2$. The waveform of electric current can be properly selected depending on the required quality and the components of aluminum support used but may be preferably a special alternating waveform as described in JP-A-56-19280 and JP-B-55-19191 (corresponding to U.S. Pat. No. 4,087,341). The waveform of electric current and the liquid conditions are properly selected depending on required electricity as well as required quality and components of aluminum support used.

The aluminum plate which has been subjected to electrolytic graining is then subjected to dipping in an alkaline solution as a part of desmutting treatment to dissolve smuts away. As such an alkaline agent, there may be used caustic soda or the like. The desmutting treatment is preferably effected at a pH value of not lower than 10 and a temperature of 25° to 60° C. for a dipping time as extremely short as 1 to 10 seconds.

The aluminum plate thus-etched is then dipped in a solution mainly composed of sulfuric acid. It is preferred that the sulfuric acid solution is in the concentration range of 50 to 400 g/l, which is much lower than the conventional value, and the temperature range of 25° to 65° C. If the concentration of sulfuric acid is more than 400 g/l or the temperature of sulfuric acid is more than 65° C., the processing bath is more liable to corrosion, and in an aluminum alloy comprising not less than 0.3% of manganese in which the manganese content is large, the grains formed by the electrochemical graining is collapsed. Further, if the aluminum plate is etched by a rate of more than 0.2 g/m$^2$, the printing durability reduces. Thus, the etching rate is preferably controlled to not more than 0.2 g/m$^2$.

The aluminum plate preferably forms an anodized film thereon in an amount of 0.1 to 10 g/m$^2$, more preferably 0.3 to 5 g/m$^2$.

The anodizing conditions vary with the electrolyte used and thus are not specifically determined. In general, it is appropriate that the electrolyte concentration is in the range of 1 to 80% by weight, the electrolyte temperature is in the range of 5° to 70° C., the electric current density is in the range of 0.5 to 60 A/dm$^2$, the voltage is in the range of 1 to 100 V, and the electrolysis time is in the range of 1 second to 5 minutes.

The grained aluminum plate having an anodized film thus-obtained is stable and excellent in hydrophilicity itself and thus can directly form a photosensitive coat thereon. If necessary, the aluminum plate may be further subjected to surface treatment.

For example, a silicate layer formed by the foregoing metasilicate of alkaline metal or an undercoating layer formed by a hydrophilic polymeric compound may be formed on the aluminum plate. The coating amount of the undercoating layer is preferably in the range of 5 to 150 mg/m$^2$.

A photosensitive coat is then formed on the aluminum plate thus treated. The photosensitive printing plate is imagewise exposed to light, and then developed to make a printing plate, and then is mounted in a printing machine for printing.

Then, the present invention will now be illustrated in and by the following example.

EXAMPLES

EXAMPLES I-1 TO I-4 AND COMPARATIVE EXAMPLES I-1 TO I-9

An aluminum raw material was molten and adjusted to form an ingot under a condition of a pouring temperature of 740° C. by means of a water-cooling fixed casting mold as shown in FIG. 1. The ingot was scalped to shave it by about 13 mm and then subjected to soaking treatment in a soaking furnace (not shown) at 550° C. for 10 hours. Thereafter, either or both of cold rolling and heat treatment was conducted once or more times and a plate having a thickness of 0.24 mm was finally produced. Samples of Examples I-1 to I-4 according to the present invention and samples of Comparative Examples I-1 to I-8 were prepared by changing the addition amount of the alloy components at the time of melting and adjusting.

The sample of Comparative Example I-9 was prepared according to the production method described in JP-A-6-48085.

Each sample was subjected to surface analysis for elemental analysis with respect to the range down to 10 μm from the plate surface layer by an Electron-Probemicroanalyzer (simply referred to as "EPMA", JXA-8800M manufactured by Japan Electron Optics Laboratory Co., Ltd.) at an acceleration voltage of 20.0 kV and a measuring current of $1.0\times10^{-6}$ A so as to determine the number and the size of intermetallic compounds.

The compositions of samples are shown in Table I-1.

TABLE I-1

| No. | Sample | Alloy Component (%) Fe | Si | Cu | Ti | Intermetallic Compound Average Particle Size (μm) | Number (/mm²) | Proportion by Number of Compounds of 10 μm or more (%) |
|---|---|---|---|---|---|---|---|---|
| 1 | Example I-1 | 0.083 | 0.035 | 0.0000 | 0.000 | 3.69 | 530 | 0.1 |
| 2 | Example I-2 | 0.085 | 0.040 | 0.0005 | 0.001 | 3.90 | 1,260 | 0.1 |
| 3 | Example I-3 | 0.086 | 0.037 | 0.001 | 0.001 | 4.02 | 1,470 | 0.1 |
| 4 | Example I-4 | 0.17 | 0.08 | 0.01 | 0.03 | 4.57 | 2,800 | 1.8 |
| 5 | Comparative Example I-1 | 0.21 | 0.01 | 0.01 | 0.03 | 4.20 | 3,500 | 0.4 |
| 6 | Comparative Example I-2 | 0.12 | 0.152 | 0.01 | 0.03 | 8.00 | 3,000 | 3.0 |
| 7 | Comparative Example I-3 | 0.90 | 0.20 | 0.03 | 0.03 | 8.50 | 2,900 | 2.0 |
| 8 | Comparative Example I-4 | 0.85 | 0.50 | 0.03 | 0.03 | 7.82 | 18,000 | 2.2 |
| 9 | Comparative Example I-5 | 0.17 | 0.08 | 0.01 | 0.06 | 4.80 | 3,800 | 1.8 |
| 10 | Comparative Example I-6 | 0.17 | 0.08 | 0.08 | 0.03 | 4.22 | 3,200 | 1.7 |
| 11 | Comparative Example I-7 | 0.004 | 0.003 | 0.001 | 0.000 | 3.22 | 30 | 0 |
| 12 | Comparative Example I-8 | 0.30 | 0.07 | 0.01 | 0.03 | 3.40 | 9,800 | 0.5 |
| 13 | Comparative Example I-9 | 0.28 | 0.09 | 0.001 | — | 3.37 | 8,900 | 0.5 |

The sample of Comparative Example I-9 was produced according to the method described in JP-A-6-48058.

The aluminum plate thus-prepared was used for the support for the planographic printing plate to subject it to etching with a 15%-aqueous solution of caustic soda at 50° C. in an etching amount of 5 g/m², and after rinsing, it was dipped in a 150 g/l sulfuric acid solution and at 50° C. for 10 sec for desmutting, followed by rinsing.

Further, the support was electrochemically grained with a 16 g/l-aqueous solution of nitric acid using an alternating (wave form) electric current described in JP-B-55-19191. The electrolytic conditions were an anode voltage $V_A$ of 14 volts and a cathode voltage $V_C$ of 12 volts, and an anode electricity quantity was set to 350 coulomb/dm².

A photosensitive planographic printing plate is prepared by coating a photosensitive solution on the substrate thus-prepared but a surface quality of the substrate before coating the photosensitive solution was evaluated herein.

It is because since developing after exposing the photosensitive planographic printing plate through a negative film or a positive film (a part of a photosensitive layer is peeled off) allows a surface itself of the substrate to become a non-image part or an image part on the planographic printing plate, a surface quality itself on the substrate surface exerts a large influence to a printing performance and visibility of the printing plate.

Further, the cost of raw material was compared. The results of comparison of the surface quality and cost of raw material are shown in Table I-2 below.

TABLE I-2

| No. | Sample | Surface Quality | Cost of Raw Material |
|---|---|---|---|
| 1 | Example I-1 | good | low |
| 2 | Example I-2 | good | low |
| 3 | Example I-3 | good | low |
| 3 | Example I-4 | fair | low |

TABLE I-2-continued

| No. | Sample | Surface Quality | Cost of Raw Material |
|---|---|---|---|
| 5 | Comparative Example I-1 | bad | fair |
| 6 | Comparative Example I-2 | bad | fair |
| 7 | Comparative Example I-3 | bad | high |
| 8 | Comparative Example I-4 | bad | high |
| 9 | Comparative Example I-5 | bad | low |
| 10 | Comparative Example I-6 | bad | low |
| 11 | Comparative Example I-7 | bad | high |
| 12 | Comparative Example I-8 | fair | high |
| 13 | Comparative Example I-9 | fair | high |

The surface of each sample of Comparative Examples I-1 to I-5 having bad surface quality was observed by EPMA and it was confirmed that samples of Comparative Example I-1 to I-4 had a streaked distribution consisting of parts where intermetallic compounds were thick and parts where they were thin and rough graining was formed in the circumference thereof, which gave rise to the bad surface quality. Also, it was confirmed that in the sample of Comparative Example I-5, a Ti intermetallic compound was stretched and no uniform graining was provided there, which caused the bad surface quality. The surface of the sample of Comparative Example I-6 having bad surface quality was observed through a scanning electron microscope (simply referred to as "SEM") and it was found that roughly grained parts and parts completely free of graining were mixed, which caused the bad surface quality. The surface of the sample of Comparative Example 7 was observed through an SEM in the same manner as above and it was found that very rough and irregularly shaped grainings were formed over a wide range, which caused the bad surface quality. This was because the intermetallic compounds were too thin and thereby the initiation points for forming grains could not be uniformly dispersed. The samples of Comparative Examples I-8 and I-9 had no problem with respect to the surface quality but have disadvantage in that the cost of raw materials was high.

The aluminum alloy support for a planographic printing plate according to the present invention comprises as described above $0<Fe\leqq 0.20$ wt %, $0\leqq Si\leqq 0.13$ wt % and $Al\geqq 99.7$ wt % and when the number of intermetallic compounds present in an arbitrary thickness direction within a depth of 10 μm from the plate surface was from 100 to 3,000 per $mm^2$, the average particle size thereof was from 0.5 to 8 μm and the proportion by number of intermetallic compounds having a particle size of 10 μm or more was 2% or less, a good surface quality and a low cost of raw materials are achieved.

EXAMPLES I-5 AND I-6 AND COMPARATIVE EXAMPLE I-10

An aluminum raw material and the like were molten and samples of Example I-5 and Comparative Example I-10 were prepared in the same manner as those of Examples I-1 to I-4.

Separately, an aluminum raw material was molten in a melt holding furnace 5 using a twin roller continuous casting apparatus shown in FIG. 2 and a continuously casted plate having a thickness of 7.5 mm was produced by a twin roller continuous casting machine 6 and then wound around a coiler 7. Subsequently, the plate was applied to a cold rolling machine shown in FIG. 3 to finally produce a plate having a thickness of 0.24 mm and thus, the sample of Example I-6 was prepared.

Each sample was examined on how the number of intermetallic compounds present in the depth of the thickness direction from the surface varied. The intermetallic compound present in the depth of the thickness direction was measured in such a manner that each sample was subjected to alkali etching to remove a predetermined amount of the surface layer part, smuts on the surface were removed by an acid and the surface analysis was carried out thereon by an Electron-Probemicroanalyzer in the same manner as in Example I-1.

The composition of each sample and the number of intermetallic compounds present in the depth of thickness direction from the surface are shown in Table I-3.

TABLE I-3

| | | Alloy Component (%) | | | | Depth in the thickness direction from the surface and number of intermetallic compounds ($mm^2$) | | | |
|---|---|---|---|---|---|---|---|---|---|
| | | | | | | 3 | 10 | 20 | 40 |
| No. | Sample | Fe | Si | Cu | Ti | μm | μm | μm | μm |
| 14 | Example I-5 | 0.120 | 0.053 | 0.001 | 0.001 | 920 | 880 | 890 | 940 |
| 15 | Example I-6 | 0.090 | 0.033 | 0.000 | 0.001 | 900 | 940 | 110 | 35 |

TABLE I-3-continued

| | | Alloy Component (%) | | | | Depth in the thickness direction from the surface and number of intermetallic compounds ($mm^2$) | | | |
|---|---|---|---|---|---|---|---|---|---|
| | | | | | | 3 | 10 | 20 | 40 |
| No. | Sample | Fe | Si | Cu | Ti | μm | μm | μm | μm |
| 16 | Comparative Example I-10 | 0.003 | 0.003 | 0.000 | 0.000 | 35 | 28 | 30 | 33 |

Each sample was subjected to surface graining in the same manner as in Example I-1 and evaluated on the surface quality. The evaluation results obtained are shown in Table I-4.

TABLE I-4

| No. | Sample | Surface quality |
|---|---|---|
| 14 | Example I-5 | good |
| 15 | Example I-6 | good |
| 16 | Comparative Example I-10 | bad |

As is seen from the results in Table I-4, in Examples I-5 and I-6, good surface quality could be obtained because the number of intermetallic compounds present within the depth of 10 μm from the surface layer was from 100 to 3,000 per $mm^2$.

According to the present invention, an aluminum alloy support for a planographic printing plate having an excellent electrolytic graining property can be obtained at a low cost as compared with conventional ones.

In the examples, description is made on a casting method using a water-cooling fixed casting mold and on a twin roller continuous casting but the present invention is by no means limited to these and a twin belt continuous casting as shown in FIG. 5 or other methods for continuously casting a thin plate may also be used. The use of the continuous casting with twin rollers or with twin belts can further reduce the production cost. (Examples II-1 to II-13 and Comparative Examples II-1 to II-13)

An aluminum raw material was molten and adjusted to form an ingot under a condition of a pouring temperature of 720° C. by means of a water-cooling fixed casting mold as shown in FIG. 1. The ingot was scalped to shave it by about 13 mm and then subjected to soaking treatment in a soaking furnace (not shown) at 550° C. for 12 hours. Thereafter, either or both of cold rolling and annealing was conducted once or more times and a plate having a thickness of 0.24 mm was finally produced. Samples of Examples II-1 to II-7 according to the present invention and samples of Comparative Examples II-1 to II-7 were prepared by changing the addition amount of the alloy components at the time of melting and adjusting.

Separately, an aluminum raw material was molten and adjusted in a melt holding furnace 5 using a continuous casting apparatus with twin rollers shown in FIG. 2 and a continuously cast-rolled plate having a thickness of 7.5 mm was formed by a continuous casting machine with twin rollers 6 and wound around a coiler 7. Thereafter, one or more of soaking treatment, cold rolling and annealing was carried out to finally produce a plate having a thickness of 0.24 mm. Samples of Examples II-8 to II-10 according to the present invention and samples of Comparative Examples II-8 to II-10 were prepared by changing the addition amount of the alloy components at the time of melting and adjusting or by changing the conditions in soaking treatment and annealing.

Further, an aluminum raw material was molten and adjusted in a melt holding furnace 5 using a twin belt continuous casting apparatus shown in FIG. 5 and a continuously casted plate having a thickness of 20 mm was formed by a twin belt continuous casting machine 10, subsequently rolled by a hot rolling machine 11 into a plate having a thickness of 3 mm and wound around a coiler 7. Thereafter, one or more of soaking treatment, cold rolling and annealing was carried out to finally produce a plate having a thickness of 0.24 mm. Samples of Examples II-11 to II-13 according to the present invention and samples of Comparative Examples II-11 to II-13 were prepared by changing the addition amount of the alloy components at the time of melting and adjusting or by changing the annealing condition.

The composition of each sample and the proportion of intermetallic compounds having a particle size of 0.1 μm or less are shown in Table II-1

TABLE II-1

| No. | Sample | Alloy Component (wt %) Fe | Si | Cu | Ti | Type of Casting | Annealing Condition | Proportion of Intermetallic Compounds having a Particle Size of 0.1 μm or less in All Intermetallic Compounds (wt %) |
|---|---|---|---|---|---|---|---|---|
| 1 | Example II-1 | 0.083 | 0.035 | 0.001 | 0.000 | fixed casting mold | none | 0.7 |
| 2 | Example II-2 | 0.083 | 0.035 | 0.001 | 0.000 | fixed casting mold | 480° C. × 10 hr. | 0.6 |
| 3 | Example II-3 | 0.083 | 0.035 | 0.001 | 0.000 | fixed casting mold | 600° C. × 10 min. | 0.5 |
| 4 | Example II-4 | 0.083 | 0.035 | 0.001 | 0.000 | fixed casting mold | 500° C. × 3 sec. | 0.7 |
| 5 | Example II-5 | 0.12 | 0.04 | 0.0005 | 0.001 | fixed casting mold | none | 1.2 |
| 6 | Example II-6 | 0.17 | 0.085 | 0.01 | 0.03 | fixed casting mold | none | 2.3 |
| 7 | Example II-7 | 0.17 | 0.085 | 0.01 | 0.03 | fixed casting mold | 480° C. × 10 hr. | 2.1 |
| 8 | Example II-8 | 0.083 | 0.035 | 0.001 | 0.000 | twin roller continuous casting | none | 1.5 |
| 9 | Example II-9 | 0.083 | 0.035 | 0.001 | 0.000 | twin roller continuous casting | 480° C. × 10 hr. | 1.0 |
| 10 | Example II-10 | 0.083 | 0.035 | 0.001 | 0.000 | twin roller continuous casting | 500° C. × 3 sec. | 1.5 |
| 11 | Example II-11 | 0.083 | 0.035 | 0.001 | 0.000 | twin belt continuous casting | none | 0.9 |
| 12 | Example II-12 | 0.083 | 0.035 | 0.001 | 0.000 | twin belt continuous casting | 480° C. × 10 hr. | 0.6 |
| 13 | Example II-13 | 0.083 | 0.035 | 0.001 | 0.000 | twin belt continuous casting | 500° C. × 3 sec. | 0.9 |
| 14 | Comp. Ex. II-1 | 0.083 | 0.035 | 0.001 | 0.000 | fixed casting mold | 280° C. × 10 hr. | about 0 |
| 15 | Comp. Ex. II-2 | 0.083 | 0.035 | 0.001 | 0.000 | fixed casting mold | 380° C. × 10 hr. | " |
| 16 | Comp. Ex. II-3 | 0.004 | 0.003 | 0.001 | 0.000 | fixed casting mold | none | " |
| 17 | Comp. Ex. II-4 | 0.083 | 0.035 | 0.001 | 0.06 | fixed casting mold | none | " |
| 18 | Comp. Ex. II-5 | 0.083 | 0.035 | 0.06 | 0.000 | fixed casting mold | none | " |
| 19 | Comp. Ex. II-6 | 0.30 | 0.14 | 0.01 | 0.01 | fixed casting mold | 480° C. × 10 hr. | " |
| 20 | Comp. Ex. II-7 | 0.30 | 0.14 | 0.01 | 0.01 | fixed casting mold | 500° C. × 3 sec. | " |
| 21 | Comp. Ex. II-8 | 0.083 | 0.035 | 0.001 | 0.001 | twin roller continuous casting | 280° C. × 10 hr. | " |
| 22 | Comp. Ex. II-9 | 0.30 | 0.14 | 0.01 | 0.01 | twin roller continuous casting | 280° C. × 10 hr. | " |
| 23 | Comp. Ex. II-10 | 0.30 | 0.14 | 0.01 | 0.01 | twin roller continuous casting | 480° C. × 10 hr. | " |

TABLE II-1-continued

| No. | Sample | Alloy Component (wt %) Fe | Si | Cu | Ti | Type of Casting | Annealing Condition | Proportion of Intermetallic Compounds having a Particle Size of 0.1 μm or less in All Intermetallic Compounds (wt %) |
|---|---|---|---|---|---|---|---|---|
| 24 | Comp. Ex. II-11 | 0.083 | 0.035 | 0.001 | 0.001 | twin belt continuous casting | 280° C. × 10 hr. | " |
| 25 | Comp. Ex. II-12 | 0.30 | 0.14 | 0.01 | 0.01 | twin belt continuous casting | 280° C. × 10 hr. | " |
| 26 | Comp. Ex. II-13 | 0.30 | 0.14 | 0.01 | 0.01 | twin belt continuous casting | 480° C. × 10 hr. | " |

The samples as described above were used for the support for the planographic printing plate to subject them to etching with a 15%-aqueous solution of caustic soda at 50° C. in an etching amount of 5 g/m$^2$, and after rinsing, they were dipped in a 150 g/l-sulfuric acid solution and at 50° C. for 10 sec for desmutting, followed by rinsing.

Further, the supports were electrochemically grained with a 16 g/l-aqueous solution of nitric acid using an alternating (wave form) current described in JP-B-55-19191. The electrolytic conditions were an anode voltage $V_A$ of 14 volts and a cathode voltage $V_C$ of 12 volts, and an anode electricity quantity was set to 350 coulomb/dm$^2$.

Subsequently, they were subjected to a chemical etching treatment with a 5%-aqueous solution of sodium hydroxide so that a dissolved amount of the aluminum plate was 0.5 g/m$^2$, and then, they were dipped in a 300 g/l-sulfuric acid solution at 60° C. for 20 seconds for the desmutting treatment.

Further, they were subjected to an anodic oxidation treatment for 60 seconds in a 150 g/l-aqueous solution of sulfuric acid and having an aluminum ion concentration of 2.5 g/l at a direct electric current of a voltage of 22 V with a distance of 150 mm between the electrodes.

The following composition was coated on the thus-obtained supports of Examples II-1 to II-13 and Comparative Examples II-1 to II-13 in a dry coated weight of 2.0 g/m$^2$ to provide a photosensitive layer.

Photosensitive solution:

N-(4-hydroxyphenyl)methacrylamide/2-hydroxyethyl methacrylate/acrylonitrile/methyl methacrlate/methacrylic acid (15/10/30/38/7 by mole ratio) copolymer (average molecular weight: 60,000) 5.0 g Hexafluorophosphate of a condensate of 4-diazophenylamine and formaldehyde 0.5 g Phosphorous acid 0.05 g Victoria Blue BOH (manufactured by Hodogaya Chemical Co., Ltd.) 0.1 g 2-Methoxyethanol 100.0 g The photosensitive planographic printing plates thus-prepared were subjected to exposure for 50 seconds with a metal halide lump of 3 kw from a distance of 1 m through a transparent negative film, and then it was subjected to development with a developing solution of the following composition and to a burning treatment at 300° C. for 7 minutes, followed by gumming in gum arabic, whereby the planographic printing plates were prepared.

Developing solution:

Sodium sulfite 5.0 g

Benzyl alcohol 30.0 g

Sodium carbonate 5.0 g

Sodium isopropylnaphthalenesulfonate 12.0 g

Pure water 1000.0 g

A printing test was carried out in a usual procedure using the planographic printing plate thus-prepared to evaluate a printing performance.

The shape of graining on the aluminum alloy support before coating thereon the photosensitive layer was observed through a scanning electron microscope (SEM).

Also, samples were compared with respect to the cost of raw materials.

The evaluation results obtained are shown in Table II-2.

TABLE II-2

| No. | Sample | Printing Test | Shape of Graining | Cost of Raw Materials |
|---|---|---|---|---|
| 1 | Example II-1 | good | uniform | low |
| 2 | Example II-2 | good | uniform | low |
| 3 | Example II-3 | good | uniform | low |
| 4 | Example II-4 | good | uniform | low |
| 5 | Example II-5 | good | uniform | low |
| 6 | Example II-6 | good | uniform | low |
| 7 | Example II-7 | good | uniform | low |
| 8 | Example II-8 | good | uniform | low |
| 9 | Example II-9 | good | uniform | low |
| 10 | Example II-10 | good | uniform | low |
| 11 | Example II-11 | good | uniform | low |
| 12 | Example II-12 | good | uniform | low |
| 13 | Example II-13 | good | uniform | low |
| 14 | Comp. Ex. II-1 | bad | destroyed | low |
| 15 | Comp. Ex. II-2 | bad | destroyed | low |
| 16 | Comp. Ex. II-3 | bad | destroyed | high |
| 17 | Comp. Ex. II-4 | bad | non-uniform | low |
| 18 | Comp. Ex. II-5 | bad | coarse graining was generated | low |
| 19 | Comp. Ex. II-6 | good | uniform | high |
| 20 | Comp. Ex. II-7 | good | uniform | high |
| 21 | Comp. Ex. II-8 | bad | destroyed | low |
| 22 | Comp. Ex. II-9 | good | uniform | high |
| 23 | Comp. Ex. II-10 | good | uniform | high |
| 24 | Comp. Ex. II-11 | bad | destroyed | low |
| 25 | Comp. Ex. II-12 | good | uniform | high |
| 26 | Comp. Ex. II-13 | good | uniform | high |

In Comparative Examples II-1, II-2, II-3, II-4, II-5, II-8 and II-11, the contents of Fe and Si fell within the scope of the present invention but since fine intermetallic compounds having a particle size of 0.1 μm or less were not present, uniform graining could not be carried out and the printing test results were bad. In Comparative Example II-3, a highly pure Al material (Al≧99.99 wt %) was used and so, the cost thereof was high. In Comparative Examples II-6, II-7, II-9, II-10, II-12 and II-13, the contents of Fe and Si were large and therefore, the graining could be made uniformly to a certain extent even in the absence of fine intermetallic compounds having a particle size of 0.1 μm or less and the printing test results were good, however, since Fe and Si had to be added as raw materials, the cost thereof was disadvantageously increased. In Comparative Example II-4, the Ti content was large and as a result, a problem in appearance was raised that streaked unevennesses were generated. In Comparative Example II-5, since the Cu content was large, the graining was not uniform and in addition, very coarse graining was generated.

As described in the foregoing, the aluminum alloy support for a planographic printing plate of the present invention achieves reduction in the cost of raw materials, is excellent in electrolytic graining property and as a result, shows good performance as a printing plate.

Also, if the casting is conducted using a twin roller continuous casting apparatus or a twin belt continuous casting apparatus as in Examples II-8 to II-13, not only the cost of raw materials but also the production cost can be reduced.

EXAMPLES III-1 TO III-5 AND COMPARATIVE EXAMPLES III-1 TO III-5

Figure 6A:
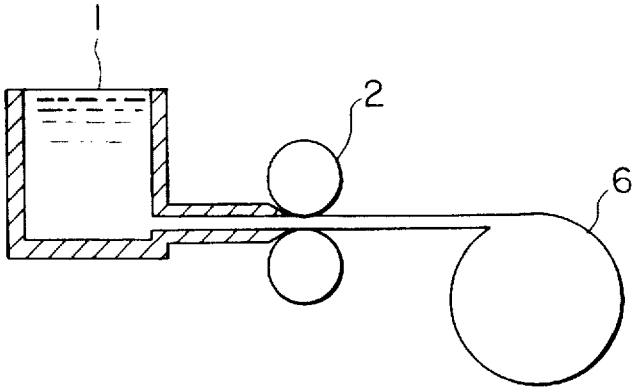
FIG. 6(A) is a side view showing one embodiment of the twin roller continuous casting process in the method for producing a support for a planographic printing plate according to the present invention.
Figure 6B:
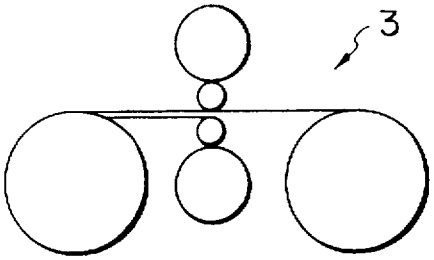
FIG. 6(B) is a side view showing one embodiment of the cold rolling process in the method for producing a support for a planographic printing plate according to the present invention.
Figure 7A:
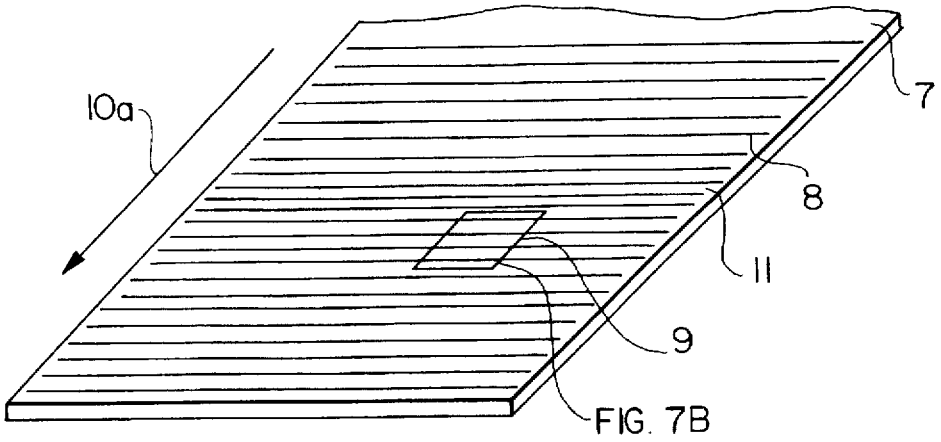
FIG. 7 is a conceptual view for measuring the concentration distribution difference of the alloy components of a continuously cast-rolled plate.
Figure 7B:
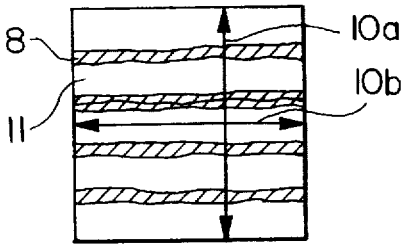

An aluminum plate member having a thickness of 7.0 mm were casted in a twin roller continuous cast-rolling apparatus as shown in FIG. 6(A) at a casting rate of 1.5 m/min. and wound around a coiler 6. Thereafter, a final plate having a thickness of 0.24 mm was produced by a cold rolling apparatus 3 shown in FIG. 6(B) and the plate was corrected by a correcting apparatus (5) shown in FIG. 6(D) to provide an aluminum support. At this stage, the components of the molten aluminum were changed to produce samples of Examples of the present invention and samples of Comparative Examples. The sample plates were collected after the continuous cast-rolling and measured on the concentration distribution difference of the alloy components in the rolling direction and on the concentration distribution difference of the alloy components in the width direction, from which the ratio of (concentration distribution difference (wt %) of the alloy components in the rolling direction/concentration distribution difference (wt %) of the alloy components in the width direction (wt %)) was calculated. In determining the concentration distribution difference in each direction, surface analysis for Fe, Si Cu and Ti was conducted by mapping (measured region: 10 mm×10 mm, measured portion: 5 portions per one sample) with an Electron-Probemicroanalyzer (simply referred to as "EPMA", JXA-8800M manufactured by Japan Electron Optics Laboratory Co., Ltd.) at an acceleration voltage of 20 kV and a measuring current of $1.0\times10^{-6}$ A and then linear analysis of the data obtained was conducted in the rolling direction and in the width direction. The average of (concentration maximum—concentration minimum (wt %)) was used as the concentration distribution difference. FIG. 7 is a conceptual view for the measurement on the concentration distribution difference of the alloy components.

The composition of each sample and the measurement results on the ratio of the concentration distribution differences are shown in Table III-1.

TABLE III-1

| No. | Sample | Alloy Component (wt %)* Fe | Si | Cu | Ti | Concentration Distribution Difference of Alloy Components in Rolling Direction/Concentration Distribution Difference of Alloy Components in Width Direction |
|---|---|---|---|---|---|---|
| III-1 | Example III-1 | 0.05 | 0.03 | 0.001 | 0.002 | 0.25 |
| III-2 | Example III-2 | 0.08 | 0.05 | 0.001 | 0.001 | 1.2 |
| III-3 | Example III-3 | 0.12 | 0.05 | 0.01 | 0.003 | 2.1 |
| III-4 | Example III-4 | 0.17 | 0.06 | 0.01 | 0.03 | 3.6 |
| III-5 | Example III-5 | 0.20 | 0.09 | 0.04 | 0.04 | 4.8 |
| III-6 | Comp. Ex. III-1 | 0.20 | 0.12 | 0.04 | 0.04 | 5.5 |
| III-7 | Comp. Ex. III-2 | 0.25 | 0.10 | 0.04 | 0.04 | 6.0 |
| III-8 | Comp. Ex. III-3 | 0.35 | 0.12 | 0.01 | 0.03 | 8.5 |
| III-9 | Comp. Ex. III-4 | 0.05 | 0.03 | 0.08 | 0.002 | 0.15 |
| III-10 | Comp. Ex. III-5 | 0.05 | 0.03 | 0.001 | 0.10 | 0.1 |

*The balance: Al (inclusive of inevitable impurities)

The aluminum plate thus-prepared was used for the support for the planographic printing plate to subject it to etching with a 5%-aqueous solution of caustic soda at 60° C. in an etching amount of 5 g/m$^2$, and after rinsing, it was dipped in a 150 g/l sulfuric acid solution and at 50° C. for 20 sec for desmutting, followed by rinsing.

Further, the support was electrochemically grained with a 16 g/l-aqueous solution of nitric acid using an alternating (wave form) electric current described in JP-B-55-19191. The electrolytic conditions were an anode voltage $V_A$ of 14 volts and a cathode voltage $V_C$ of 12 volts, and an anode electricity quantity was set to 350 coulomb/dm$^2$.

Subsequently, the support was dipped in a 300 g/l-sulfuric acid solution at 60° C. for 20 seconds for the desmutting treatment.

Further, it was subjected to an anodic oxidation treatment for 60 seconds in a 150 g/l-aqueous solution of sulfuric acid and having an aluminum ion concentration of 2.5 g/l at a direct electric current of a voltage of 22 V with a distance of 150 mm between the electrodes.

A photosensitive planographic printing plate is prepared by coating a photosensitive solution on the substrate thus-prepared but a surface quality of the substrate before coating the photosensitive solution was evaluated herein.

It is because since developing after exposing the photosensitive planographic printing plate through a negative film or a positive film (a part of a photosensitive layer is peeled off) allows a surface itself of the substrate to become a non-image part or an image part on the planographic printing plate, a surface quality itself on the substrate surface exerts a large influence to a printing performance and visibility of the printing plate.

Using samples shown in Table III-1, appearance evaluation on the stepped unevennesses of continuously cast-rolled plates and appearance evaluation of the final plates obtained as above were conducted and the results are shown in Table III-2.

TABLE III-2

| No. | Sample | Appearance Evaluation on Stepped Unevennesses of Continuously Cast-Rolled Plate | Appearance Evaluation after Graining of Final Plate |
|---|---|---|---|
| III-1 | Example III-1 | Good | Good |
| III-2 | Example III-2 | Good | Good |
| III-3 | Example III-3 | Good | Good |
| III-4 | Example III-4 | Fair | Good |
| III-5 | Example III-5 | Fair | Good |
| III-6 | Comparative Example III-1 | Bad | Stepped unevennesses occurred |
| III-7 | Comparative Example III-2 | Bad | Stepped unevennesses occurred |
| III-8 | Comparative Example III-3 | Bad | Stepped unevennesses occurred |
| III-9 | Comparative Example III-4 | Good | Streaked unevennesses occurred |
| III-10 | Comparative Example III-5 | Good | Streaked unevennesses occurred |

As is seen from Table III-2, in Samples III-1 to III-5 (Examples III-1 to III-5) of the present invention, stepped unevennesses were difficultly generated at the time of the continuous cast-rolling and each final plate after graining was good in appearance. On the other hand, among samples outside of the present invention, Samples III-6, III-7 and III-8 (Comparative Example III-1, III-2 and III-3) each had the concentration distribution difference in the continuous cast-rolling direction fairly larger than the concentration distribution difference in the plate width direction and the ratio of these differences was from 5.5 to 8.5, whereby stepped unevennesses were generated at the continuous cast-rolling and also each final plate had stepped unevennesses. In Samples III-9 and III-10 (Comparative Examples III-4 and III-5), the contents of Fe and Si fell within the scope of the present invention and stepped unevennesses were not generated on the continuously cast-rolled plate but the contents of Cu and Ti were outside the scope of the present invention and as a result, the concentration distribution difference in the plate width direction was fairly larger than the concentration distribution difference in the rolling direction to give their ratio of from 0.1 to 0.15, whereby streaked unevennesses extending towards the rolling direction were generated on each final plate.

Figure 6C:
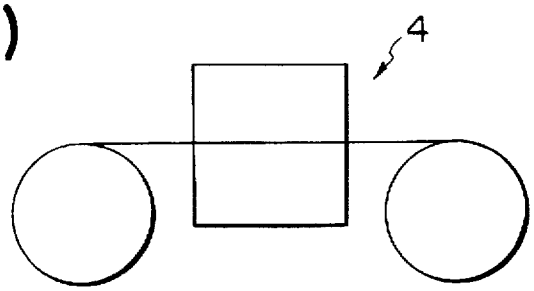
FIG. 6(C) is a side view showing one embodiment of the heat treating process in the method for producing a support for a planographic printing plate according to the present invention.
Figure 6D:
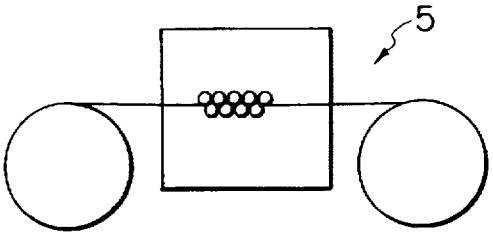
FIG. 6(D) is a side view showing one embodiment of the correcting process in the method for producing a support for a planographic printing plate according to the present invention.

In the Examples above, samples not subjected to annealing by a heat treating machine (4) as shown in FIG. 6(C) after twin roller continuous casting are presented but the present invention is by no means limited to these but annealing by the heat treating machine may be conducted, for example, to adjust the mechanical strength or to control the crystal constitution. The heat treating machine is also not limited to the continuous type as shown in FIG. 6(C) but a batch-type heating furnace (not shown) may be used.

As described in the foregoing, the planographic plate produced by the method for producing a support for a planographic printing plate according to the present invention shows extremely improved surface quality after graining as compared with conventional plates.

Further, since the twin roller continuous casting method can be used, the production procedure can be largely rationalized and a great effect can be provided on the reduction of the production cost.

Still further, by using alloy components falling within the scope of the present invention, the addition amount of the alloy components using an expensive mother alloy can be reduced to a large extent and because of no need to add alloy components, a great effect can be provided on the reduction of the production cost.

While the invention has been described in detail and with reference to specific embodiments thereof, it will be apparent to one skilled in the art that various changes and modifications can be made therein without departing from the spirit and scope thereof.

What is claimed is:

1. An aluminum alloy support for a planographic printing plate, which is an aluminum alloy plate comprising $0<Fe\leqq0.20$ wt %, $0\leqq Si\leqq0.13$ wt %, $Al\geqq99.7$ wt % and the balance of inevitable impurity elements, wherein the number of intermetallic compounds present in the arbitrary thickness direction within 10 μm from the plate surface is from 100 to 3,000 per $mm^2$ and the intermetallic compound has an average particle size of from 0.5 to 8 μm, with the intermetallic compounds having a particle size of 10 μm or more being in a proportion by number of 2% or less.

2. The aluminum alloy support for a planographic printing plate as claimed in claim 1, wherein the components of said aluminum alloy support contain $0\leqq Ti\leqq0.05$ wt % and $0\leqq Cu\leqq0.05$ wt %.

3. An aluminum alloy support for a planographic printing plate, which is an aluminum alloy plate comprising $0<Fe\leqq0.20$ wt %, $0\leqq Si\leqq0.13$ wt %, $Al\geqq99.7$ wt % and the balance of inevitable impurity elements, wherein the intermetallic compounds contained in said aluminum alloy plate and having a particle size of 0.1 μm or less are present at a proportion of 0.5 wt % or more of all intermetallic compounds.

4. The aluminum alloy support for a planographic printing plate as claimed in claim 3, wherein the aluminum alloy support contains $0\leqq Ti\leqq0.05$ wt % and $0\leqq Cu\leqq0.05$ wt %.

* * * * *